US006052915A

United States Patent [19]

Turner

[11] Patent Number: 6,052,915

[45] Date of Patent: Apr. 25, 2000

[54] HANDS-FREE PORTABLE HAIRDRYER

[76] Inventor: Cheryl G. Turner, 10039 Southridge Dr., Oklahoma City, Okla. 73159

[21] Appl. No.: 09/186,257

[22] Filed: Nov. 5, 1998

[51] Int. Cl.[7] ..... A45D 20/00

[52] U.S. Cl. ..... 34/99

[58] Field of Search ..... 34/96, 97, 98, 34/99, 100, 101, 283, 392, 380

[56] References Cited

U.S. PATENT DOCUMENTS

| | | | |
|---|---|---|---|
| 5,235,760 | 8/1993 | Bastien | 34/99 |
| 5,404,652 | 4/1995 | Sher | 34/90 |
| 5,531,032 | 7/1996 | Wooderson et al. | 34/90 |
| 5,592,749 | 1/1997 | Trimmer | 34/97 |
| 5,651,190 | 7/1997 | Sanders | 34/99 |
| 5,787,601 | 8/1998 | Stelly | 34/99 |
| 5,829,157 | 11/1998 | Gittens et al. | 34/99 |
| 5,839,204 | 11/1998 | Cinque et al. | 34/97 |
| 5,887,357 | 3/1999 | McNair | 34/99 |

*Primary Examiner*—Henry Bennett
*Assistant Examiner*—Andrea M. Joyce

[57] ABSTRACT

A portable hairdryer used for permitting a user to move freely while simultaneously drying the user's hair. The portable hairdryer includes a flexible cap with spaced apart inner and outer layers each having a plurality of apertures therethrough. One end of an elongate flexible tubular hose is coupled to the cap. The other end of the hose is coupled to a blower housing. At least one heating element is mounted in the blower housing. A battery power source is mounted in the blower housing and is electrically connected to the heating element. A fan is mounted in the housing and is electrically connected to the battery power source. An elongate flexible belt is coupled to the blower housing.

12 Claims, 2 Drawing Sheets

HANDS-FREE PORTABLE HAIRDRYER

BACKGROUND OF THE INVENTION

1. Field of the Invention

The present invention relates to portable hairdryers and more particularly pertains to a new portable hairdryer for permitting a user to move freely while simultaneously drying the user's hair.

2. Description of the Prior Art

The use of portable hairdryers is known in the prior art. More specifically, portable hairdryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,986,272 by Fierabent; U.S. Pat. No. 4,658,511 by Mahlich et al.; U.S. Pat. No. 3,983,638 by Magid ; U.S. Pat. No. 4,800,654 by Levin et al.; U.S. Pat. No. 4,903,416 by Levin et al.; and U.S. Pat. No. 5,155,925 by Choi.

While these devices fulfill their respective, particular objectives and requirements, the aforementioned patents do not disclose a new portable hairdryer. The inventive device includes a flexible cap with spaced apart inner and outer layers each having a plurality of apertures therethrough. One end of an elongate flexible tubular hose is coupled to the cap. The other end of the hose is coupled to a blower housing. At least one heating element is mounted in the blower housing. A battery power source is mounted in the blower housing and is electrically connected to the heating element. A fan is mounted in the housing and is electrically connected to the battery power source. An elongate flexible belt is coupled to the blower housing.

In these respects, the portable hairdryer according to the present invention substantially departs from the conventional concepts and designs of the prior art, and in so doing provides an apparatus primarily developed for the purpose of permitting a user to move freely while simultaneously drying the user's hair.

SUMMARY OF THE INVENTION

In view of the foregoing disadvantages inherent in the known types of portable hairdryers now present in the prior art, the present invention provides a new portable hairdryer construction wherein the same can be utilized for permitting a user to move freely while simultaneously drying the user's hair.

The general purpose of the present invention, which will be described subsequently in greater detail, is to provide a new portable hairdryer apparatus and method which has many of the advantages of the portable hairdryers mentioned heretofore and many novel features that result in a new portable hairdryer which is not anticipated, rendered obvious, suggested, or even implied by any of the prior art portable hairdryers, either alone or in any combination thereof.

To attain this, the present invention generally comprises a flexible cap with spaced apart inner and outer layers each having a plurality of apertures therethrough. One end of an elongate flexible tubular hose is coupled to the cap. The other end of the hose is coupled to a blower housing. At least one heating element is mounted in the blower housing. A battery power source is mounted in the blower housing and is electrically connected to the heating element. A fan is mounted in the housing and is electrically connected to the battery power source. An elongate flexible belt is coupled to the blower housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable hairdryer apparatus and method which has many of the advantages of the portable hairdryers mentioned heretofore and many novel features that result in a new portable hairdryer which is not anticipated, rendered obvious, suggested, or even implied by any of the prior art portable hairdryers, either alone or in any combination thereof.

It is another object of the present invention to provide a new portable hairdryer which may be easily and efficiently manufactured and marketed.

It is a further object of the present invention to provide a new portable hairdryer which is of a durable and reliable construction.

An even further object of the present invention is to provide a new portable hairdryer which is susceptible of a low cost of manufacture with regard to both materials and labor, and which accordingly is then susceptible of low prices of sale to the consuming public, thereby making such portable hairdryer economically available to the buying public.

Still yet another object of the present invention is to provide a new portable hairdryer which provides in the apparatuses and methods of the prior art some of the advantages thereof, while simultaneously overcoming some of the disadvantages normally associated therewith.

Still another object of the present invention is to provide a new portable hairdryer for permitting a user to move freely while simultaneously drying the user's hair.

Yet another object of the present invention is to provide a new portable hairdryer which includes a flexible cap with spaced apart inner and outer layers each having a plurality of apertures therethrough. One end of an elongate flexible tubular hose is coupled to the cap. The other end of the hose is coupled to a blower housing. At least one heating element is mounted in the blower housing. A battery power source is mounted in the blower housing and is electrically connected to the heating element. A fan is mounted in the housing and is electrically connected to the battery power source. An elongate flexible belt is coupled to the blower housing.

Still yet another object of the present invention is to provide a new portable hairdryer that has a rechargeable battery power source so that the user is not constrained by an electrical cord connecting the portable hairdryer to an electrical power source.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
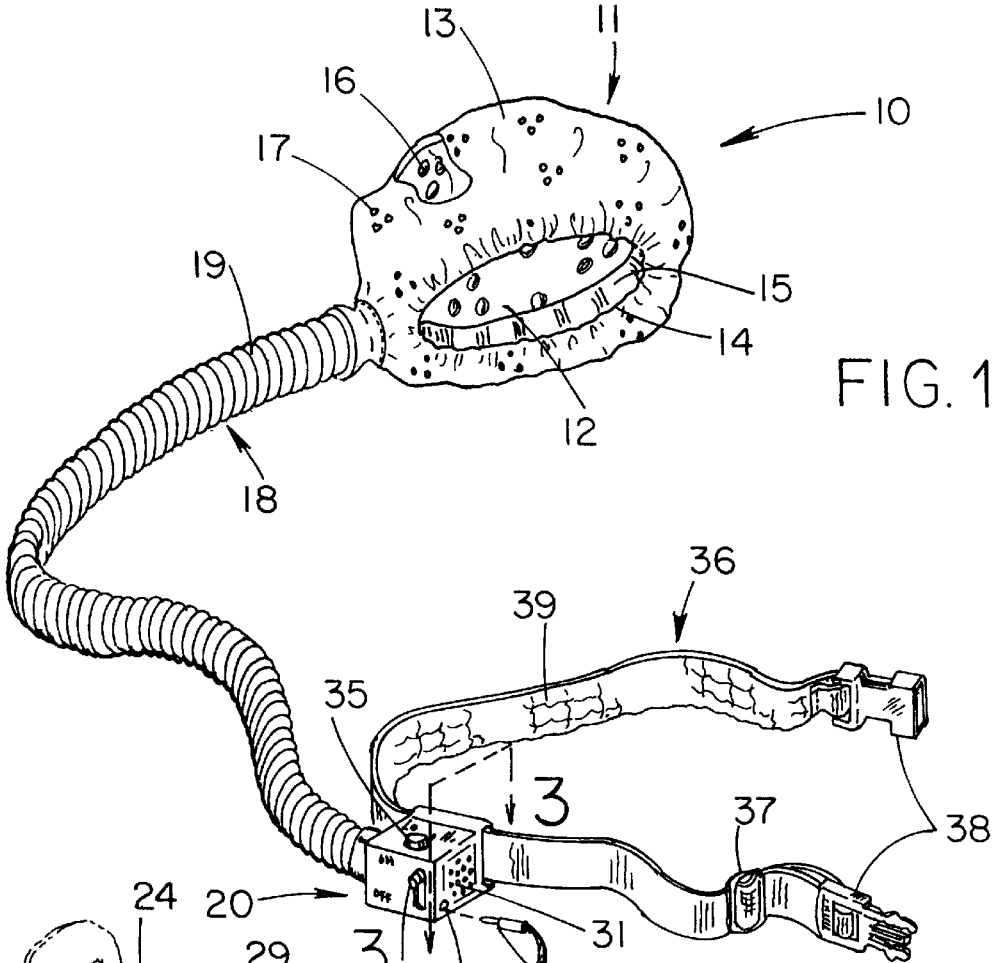
FIG. 1 is a schematic perspective view of a new portable hairdryer according to the present invention.
Figure 2:
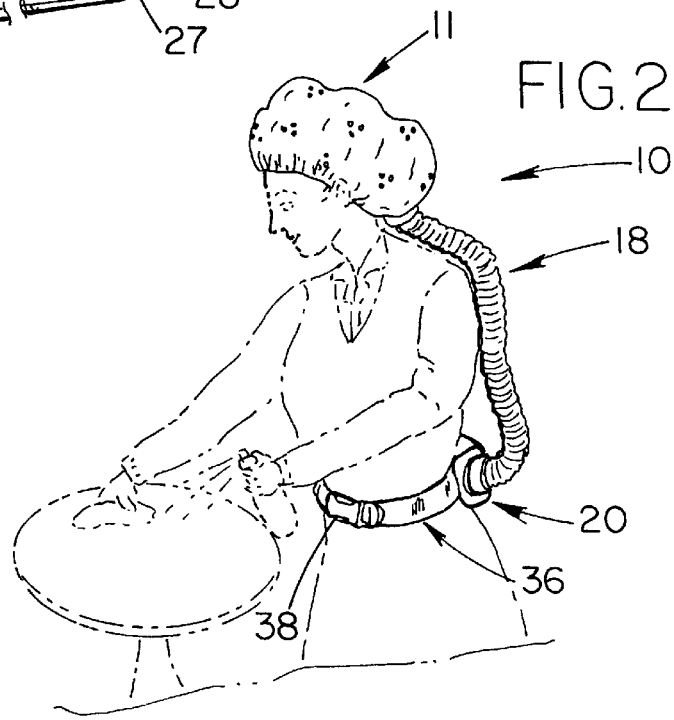
FIG. 2 is a schematic side view of the present invention in use on a user.
Figure 4:
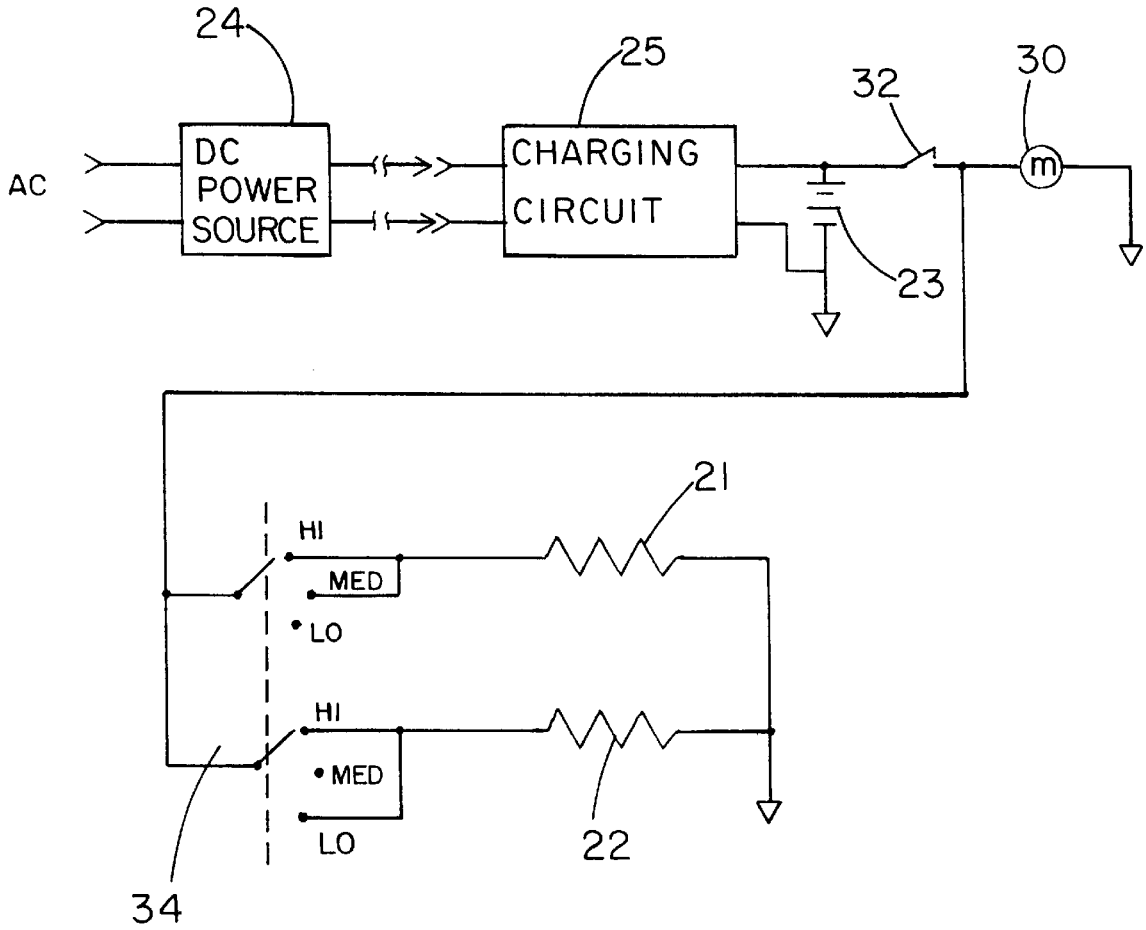
FIG. 4 is an electrical schematic of the present invention.

With reference now to the drawings, and in particular to FIGS. 1 through 4 thereof, a new portable hairdryer embodying the principles and concepts of the present invention and generally designated by the reference numeral 10 will be described.

As best illustrated in FIGS. 1 through 4, the portable hairdryer 10 generally comprises a flexible cap with spaced apart inner and outer layers each having a plurality of apertures therethrough. One end of an elongate flexible tubular hose is coupled to the cap. The other end of the hose is coupled to a blower housing. At least one heating element is mounted in the blower housing. A battery power source is mounted in the blower housing and is electrically connected to the heating element. A fan is mounted in the housing and is electrically connected to the battery power source. An elongate flexible belt is coupled to the blower housing.

In closer detail, the hairdryer 10 includes a flexible cap 11 designed for wear on the head of a user such that the hair of the user is covered by the cap. The cap has spaced apart and generally coextensive inner and outer layers 12,13, and an opening 14 therein designed for receiving the head of a user therein. The opening of the cap has an generally circular outer periphery where the inner and outer layers are coupled together therearound. The cap preferably has an elastic head band 15 around the outer periphery of the opening of the cap for helping hold the cap on the head of the user.

The inner and outer layers of the cap each have a plurality of apertures 16,17 therethrough. The apertures of the inner layer are designed for permitting the passage of air therethrough to dry the hair of the user. In use, the apertures of the outer layer are designed for permitting the passage of exhaust air therethrough to keep the cap from becoming too inflated. The apertures of the inner and outer layers of the cap each are generally circular and each have a diameter. The diameter of each of the apertures of the inner layer of the cap is preferably greater than the diameter of each of the apertures of the outer layer of the cap.

The apertures of the inner layer of the cap are preferably arranged in groups of three on the inner layer of the cap. Each group of apertures of the inner layer is spaced apart from the other groups of apertures of the inner layer for providing even distribution of air to the head of a user and permitting sufficient air to pass to the head of the user. Similarly, the apertures of the outer layer of the cap are preferably arranged in groups of three on the outer layer of the cap. Each group of apertures of the outer layer is spaced apart from the other groups of apertures of the outer layer.

An elongate flexible tubular hose 18 having is provided a pair of opposite ends. The tubular hose preferably has a plurality of spaced apart annular constrictions 19 therearound. The annular constrictions of the hose are arranged in a row along the hose extending between the ends of the hose. Ideally, the annular constrictions of the hose are spaced apart at generally equal intervals in the row of annular constrictions. In use, the annular constrictions are designed for enhancing the flexibility and compression of the hose for convenient storage while providing optimal strength to the hose.

A first of the ends of the hose is coupled to the cap to fluidly connect the hose to the space between the inner and outer layers of the cap. A generally rectangular-box-shaped blower housing 20 is provided having a plurality of generally rectangular faces. A second of the ends of the hose is coupled to a first face of the blower housing to fluidly connect the hose to the interior of the blower housing.

First and second heating elements 21,22 are mounted in the blower housing. The first and second heating elements provide heat when energized to heat the air in the blower housing. A battery power source 23 is also mounted in the blower housing and is electrically connected to the first and second heating elements to energize the heating elements. Preferably, an alternating current to direct current converter 24 is provided either in or out of the blower housing. A charging circuit 25 is provided in the blower housing and are electrically connected to the battery power source for recharging the battery power source.

The blower housing preferably has a socket 26 in a second of the faces of the blower housing which is electrically connected to the battery power source via the charging circuit and current converter. An elongate flexible electric power cord 27 has a first plug 28 which is inserted into the socket of the blower to electrically connect the power cord to the receptacle of the blower housing and thereby the battery power source. The power cord also has a second plug 29 designed for insertion into an electrical receptacle via the alternating current to direct current converter to electrically connect the power cord to an external electrical power supply.

A motorized fan 30 is mounted in the housing to permit rotation of the fan in the housing. The fan is electrically connected to the battery power source. In use, the fan rotates when energized to blow air from the blower housing into the hose such that heated air from the blower housing through the hose into the space between the inner and outer layers of the cap and out through the apertures of the inner and outer layers of the cap to dry the hair of the user. Preferably, the second face of the blower housing has a plurality of vent holes 31 therethrough to permit drawing of passage of air into the blower housing. The first and second faces of the blower housing preferably facing one another and lie in substantially parallel planes to one another.

A switch 32 is electrically connected to battery power source to selectively activate and deactivate the heater and fan. The switch has an actuator 33 mounted to a third face of the blower housing. A temperature controller 34 is electrically connected to the first and second heating elements to control the amount of heat provided by the heating elements. The temperature controller has an actuator 35 is mounted to a fourth face of the blower housing. Preferably, the switch has at least three settings to control the amount of heat provided by each of the heating elements.

An elongate flexible belt 36 is coupled to a fifth face of the blower housing. The belt has a pair of opposite ends and first and second faces. Preferably, the belt has an adjustment buckle 37 to permit adjustment of the length of the belt between the ends of the belt. In use, the belt is designed for wrapping around a waist of a user such that the first face of the belt faces the waist of the user. The ends of the belt are coupled together preferably a buckle 38 (ideally, a quick-release style buckle) to permit easy detachment of the ends of the belt. Preferably, the first face of the belt has a resiliently compressible padding 39 provided thereon. In use, the padding of the first face of the belt is designed for providing additional comfort to the user when the belt is wrapped around the waist of the user.

Figure 3:
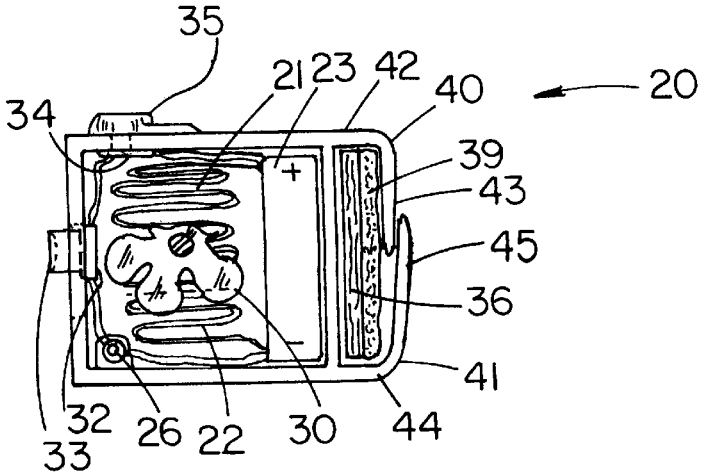
FIG. 3 is a schematic cross sectional view of the blower housing of the present invention taken from line 3—3 of FIG. 1.

Preferably, the fifth face of the blower housing has an opposing pair of generally L-shaped resiliently deflectable arms 40,41. Each of the arms has proximal and distal portions 42,44,43,45. The proximal portions 42,44 of the arms are coupled to the fifth face of the blower housing so that the distal portions 43,45 of the arms are spaced apart from the fifth face of the blower housing. The distal portions of the arms are preferably extended generally perpendicular to the proximal portion of the respective arm. As illustrated in FIG. 3, the belt is extended between the fifth face of the blower housing and the distal portions of the arms to permit sliding of the belt therebetween. The distal portion of the one of the arms overlaps the distal portion of the other of the arms to hold the belt between the arms and the blower housing and to permit deflection of the arms to let the belt pass through the arms when desired.

In an ideal illustrative embodiment, the hose has a length defined between the ends of the hose of about 24 inches and the hairdryer has an overall weight no more than about 2 pounds.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hairdryer, comprising:

a flexible cap adapted for wear on the head of a user, said cap having spaced apart inner and outer layers, and an opening therein adapted for receiving the head of a user therein;

said inner and outer layers of said cap each having a plurality of apertures therethrough;

an elongate flexible tubular hose having a pair of opposite ends;

a first of said ends of said hose being coupled to said cap to fluidly connect said hose to said space between said inner and outer layers of said cap;

a blower housing;

a second of said ends of said hose being coupled to said blower housing to fluidly connect said hose to said blower housing;

at least one heating element being mounted in said blower housing;

a battery power source being mounted in said blower housing and being electrically connected to said heating element;

a fan being mounted in said housing, said fan being electrically connected to said battery power source;

an elongate flexible belt being coupled to said blower housing;

said belt having a pair of opposite ends and first and second faces;

said ends of said belt being coupled together; and wherein said blower housing has an opposing pair of generally L-shaped resilient arms, each of said arms having proximal and distal portions, said proximal portions of said arms being coupled to said blower housing, said distal portions of said arms being spaced apart from said blower housing, said belt being extended between said blower housing and said distal portions of said arms.

2. The hairdryer of claim 1, wherein said opening of said cap has an outer periphery, said inner and outer layers being coupled together around said outer periphery of said opening of said cap, and wherein said cap has an elastic head band around said outer periphery of said opening of said cap.

3. The hairdryer of claim 1, wherein said apertures of said inner and outer layer of said cap each being generally circular and having a diameter, said diameter of each of said apertures of said inner layer of said cap being greater than said diameter of each of said apertures of said outer layer of said cap.

4. The hairdryer of claim 3, wherein said apertures of said inner layer of said cap are arranged in groups of three on said inner layer of said cap, each group of apertures of said inner layer being spaced apart from the other groups of apertures of said inner layer, and wherein said apertures of said outer layer of said cap are arranged in groups of three on said outer layer of said cap, each group of apertures of said outer layer being spaced apart from the other groups of apertures of said outer layer.

5. The hairdryer of claim 1, wherein said tubular hose has a plurality of spaced apart annular constrictions therearound, said annular constrictions of said hose being arranged in a row extending between said ends of said hose.

6. The hairdryer of claim 5, wherein said annular constrictions of said hose are spaced apart at generally equal intervals in said row of annular constrictions.

7. The hairdryer of claim 1, wherein said blower housing has a socket, said socket being electrically connected to said battery power source.

8. The hairdryer of claim 7, further comprising an elongate flexible electric power cord having a first plug being inserted into said socket of said blower to electrically connect said power cord to said receptacle of said blower housing, said power cord having a second plug adapted for insertion into an electrical receptacle to electrically connect said power cord to an external electrical power supply.

9. The hairdryer of claim 1, wherein said blower housing has a plurality of vent holes therethrough to permit passage of air into said blower housing.

10. The hairdryer of claim 1, wherein said distal portions of said arms are extended generally perpendicular to the proximal portion of the respective arm.

11. The hairdryer of claim 1, wherein said distal portion of said one of said arms overlap said distal portion of the other of said arms.

12. A hairdryer, comprising:

a flexible cap adapted for wear on the head of a user, said cap having spaced apart and generally coextensive inner and outer layers, and an opening therein adapted for receiving the head of a user therein;

said opening of said cap having an outer periphery, said inner and outer layers being coupled together around said outer periphery of said opening of said cap;

said cap having an elastic head band around said outer periphery of said opening of said cap;

said inner and outer layers of said cap each having a plurality of apertures therethrough;

said apertures of said inner and outer layer of said cap each being generally circular and having a diameter, said diameter of each of said apertures of said inner layer of said cap being greater than said diameter of each of said apertures of said outer layer of said cap;

said apertures of said inner layer of said cap being arranged in groups of three on said inner layer of said cap, each group of apertures of said inner layer being spaced apart from the other groups of apertures of said inner layer;

said apertures of said outer layer of said cap being arranged in groups of three on said outer layer of said cap, each group of apertures of said outer layer being spaced apart from the other groups of apertures of said outer layer;

an elongate flexible tubular hose having a pair of opposite ends;

said tubular hose having a plurality of spaced apart annular constrictions therearound, said annular constrictions of said hose being arranged in a row extending between said ends of said hose, said annular constrictions of said hose being spaced apart at generally equal intervals in said row of annular constrictions;

a first of said ends of said hose being coupled to said cap to fluidly connect said hose to said space between said inner and outer layers of said cap;

a generally rectangular-box-shaped blower housing having a plurality of generally rectangular faces;

a second of said ends of said hose being coupled to first face of said blower housing to fluidly connect said hose to said blower housing;

a first and second heating elements being mounted in said blower housing;

a battery power source being mounted in said blower housing and being electrically connected to said first and second heating elements;

said blower housing having a socket in a second of said faces of said blower housing, said socket being electrically connected to said battery power source;

an elongate flexible electric power cord having a first plug being inserted into said socket of said blower to electrically connect said power cord to said receptacle of said blower housing;

said power cord having a second plug adapted for insertion into an electrical receptacle to electrically connect said power cord to an external electrical power supply;

a fan being mounted in said housing, said fan being electrically connected to said battery power source;

said second face of said blower housing having a plurality of vent holes therethrough to permit passage of air into said blower housing;

said first and second faces of said blower housing facing one another and lying in substantially parallel planes to one another;

a switch being electrically connected to battery power source, said switch having an actuator mounted to a third face of said blower housing;

a temperature controller being electrically connected to said first and second heating elements to control the amount of heat provided by said heating elements, said temperature controller having an actuator being mounted to a fourth face of said blower housing;

an elongate flexible belt being coupled to a fifth face of said blower housing;

said belt having a pair of opposite ends and first and second faces;

said belt being adapted for wrapping around a waist of a user such that said first face of said belt faces the waist of the user;

said ends of said belt being coupled together, wherein a buckle detachably couples said ends of said belt together;

said first face of said belt having a resiliently compressible padding provided thereon;

said fifth face of said blower housing having an opposing pair of generally L-shaped resilient arms, each of said arms having proximal and distal portions, said proximal portions of said arms being coupled to said fifth face of said blower housing, said distal portions of said arms being spaced apart from said fifth face of said blower housing;

said distal portions of said arms being extended generally perpendicular to the proximal portion of the respective arm;

said belt being extended between said fifth face of said blower housing and said distal portions of said arms; and said distal portion of said one of said arms overlapping said distal portion of the other of said arms.

* * * * *